US006230364B1

(12) United States Patent
Cheal

(10) Patent No.: US 6,230,364 B1
(45) Date of Patent: May 15, 2001

(54) HINGED CLOSURES

(75) Inventor: Jon Paul Anthony Cheal, Tamworth (GB)

(73) Assignee: ITW Limited (GB)

( * ) Notice: Subject to any disclaimer, the term of this patent is extended or adjusted under 35 U.S.C. 154(b) by 0 days.

(21) Appl. No.: 09/169,152

(22) Filed: Oct. 9, 1998

(30) Foreign Application Priority Data

Oct. 9, 1997 (GB) ..... 9721303

(51) Int. Cl.[7] ..... E05F 1/08
(52) U.S. Cl. ..... 16/289; 16/288; 16/286
(58) Field of Search ..... 16/280, 282, 284, 16/287, 288, 289, 290, 286; 296/76; 49/386; 180/69.2, 69.21

(56) References Cited

U.S. PATENT DOCUMENTS 2,520,921 * 9/1950 Foster ..... 16/289
2,720,676 * 10/1955 Vigmostad ..... 16/289
3,195,173 * 7/1965 McNay et al. ..... 16/289
3,351,975 * 11/1967 Goto ..... 16/289
4,580,315 * 4/1986 Beckwith ..... 16/289
4,679,841 * 7/1987 Taunay ..... 296/76
4,966,403 * 10/1990 Nordstrom ..... 16/289
5,008,977 * 4/1991 Lautenschlager et al. ..... 16/288
5,373,609 * 12/1994 Ferrari et al. ..... 16/288
5,544,388 * 8/1996 Chiura ..... 16/289

FOREIGN PATENT DOCUMENTS 0 808 982 11/1997 (EP) .

* cited by examiner

*Primary Examiner*—Chuck Y. Mah
(74) *Attorney, Agent, or Firm*—Schwartz & Weinrieb

(57) ABSTRACT

A hinge mechanism for assisting the lifting of a trunk lid of a vehicle comprises a V-shaped leaf spring (12) mounted on a first hinge part (2) attached to the vehicle body, and a roller element (32) mounted on a second hinge part (4) attached to the lid. A compressible gas strut (38) may be connected directly between the lid and the body; alternatively the strut may be connected between the first and second hinge parts, (2, 4) so that the resulting sub-assembly can be mounted directly to the lid and body on the vehicle assembly line. The hinge mechanism assists in initially lifting the trunk lid so that the gas strut (38) is disposed in an advantageous leveraged position at which it can continue the lifting movement of the trunk lid.

20 Claims, 2 Drawing Sheets

HINGED CLOSURES

FIELD OF THE INVENTION

The present invention relates generally to hinged closures, and more particularly, the invention concerns improvements in mechanisms for assisting the lifting of hinged closures, in particular car trunk lids and tailgates, and car hoods.

BACKGROUND OF THE INVENTION

It has become a requirement in the motor industry that car trunk lids, that is, the trunk or rear lid should need little or no manual effort to be opened, especially starting from the closed position. For example a person wishing to load luggage or shopping articles into the trunk of a car often has only one hand free, so that the lid has to be unlocked and lifted single-handedly. This can be a real problem for elderly or infirm persons.

In many cars nowadays the trunk lids are pivoted about a pair of four-link hinges. When the lid is closed each hinge is stowed, along with its gas strut, in a respective shallow gutter on each side of the trunk. This has the advantage that the trunk space remains unobstructed by the hinge mechanism. However, the almost horizontal attitude of the gas strut provides a poor mechanical advantage in assisting the initial opening of the lid, namely at the very position where the effective weight of the lid is greatest.

In co-pending European Patent Application No. 97303390.5 there is described and claimed a hinged mechanism for assisting the lifting of a closure hinged to a body, comprising: a hinge device permitting pivoting of the closure about the body, and a compressible strut acting between a first hinge part attachable to the body and a second hinge part attachable to the closure; wherein one end of the strut acts through a pivotal thrust member whose movement is constrained by engagement of a part thereof with plate means, at least when the two hinge parts are in close proximity with respect to each other, such as when the closure is in the lowered position, whereby during initial opening of the closure the plate means enables pivoting movement of the thrust member, due to the force of the strut, to cause a lifting movement of the closure.

OBJECT OF THE INVENTION

It is an object of the present invention to provide an improved and simpler mechanism for initially lifting a closure, in particular a motor vehicle trunk lid.

SUMMARY OF THE INVENTION

According to the present invention there is provided a hinge mechanism for assisting the lifting of a closure hinged to a body, comprising a hinge device permitting pivoting of the closure about the body and including a first hinge part attachable to the body and a second hinge part attachable to the closure, and spring means mounted on one of the hinge parts and engageable with an element on the other hinge part, whereby when the hinge parts are in close proximity with respect to each other, such as when the closure is in a lowered position, the spring means acts on the second hinge part to cause at least a partial lifting movement of the closure.

Preferably the hinge device is a four-link hinge, the first and second hinge parts being connected by a short link and a long link.

In a preferred arrangement the spring means is associated with the first hinge part while the element is attached to the second hinge part.

The first hinge part may have an elongated end which in use with a closure, is remote from the opening edge of the closure.

Preferably the spring means is a leaf spring; and where the first hinge part is elongated, the leaf spring may be generally of a V-shape, having first and second limbs joined by a bight section which passes around a pin at the elongate end of the first hinge part.

The first limb of the spring may be flat for engaging a corresponding portion of the first hinge part.

The second limb, when in its uncompressed state, is preferably of a curved shaped with its free end curving away from the first limb.

Where the spring means is a leaf spring, the element in the second hinge part preferably comprises a roller which is engageable with the outer surface of the leaf spring.

Since in the fully closed position of the hinge mechanism the roller will engage the portion of the spring nearer the bight section, a large force is initially applied to the second hinge part which enables the lid to start opening, whereupon during reduction of the spring force the gas strut progressively takes over to continue opening the lid.

The invention also extends to a hinge mechanism as above defined, in which a compressible strut is pivotally connected between the first and second hinge parts. The strut is preferably a gas strut.

Alternatively the strut may be connected directly between the closure and the body of the vehicle.

BRIEF DESCRIPTION OF THE DRAWINGS

An example of a hinge mechanism in accordance with the invention will now be described with reference to the accompanying drawings, in which like reference characters designate like or corresponding parts throughout the several views, and wherein.

DETAILED DESCRIPTION OF THE INVENTION

Figure 1:
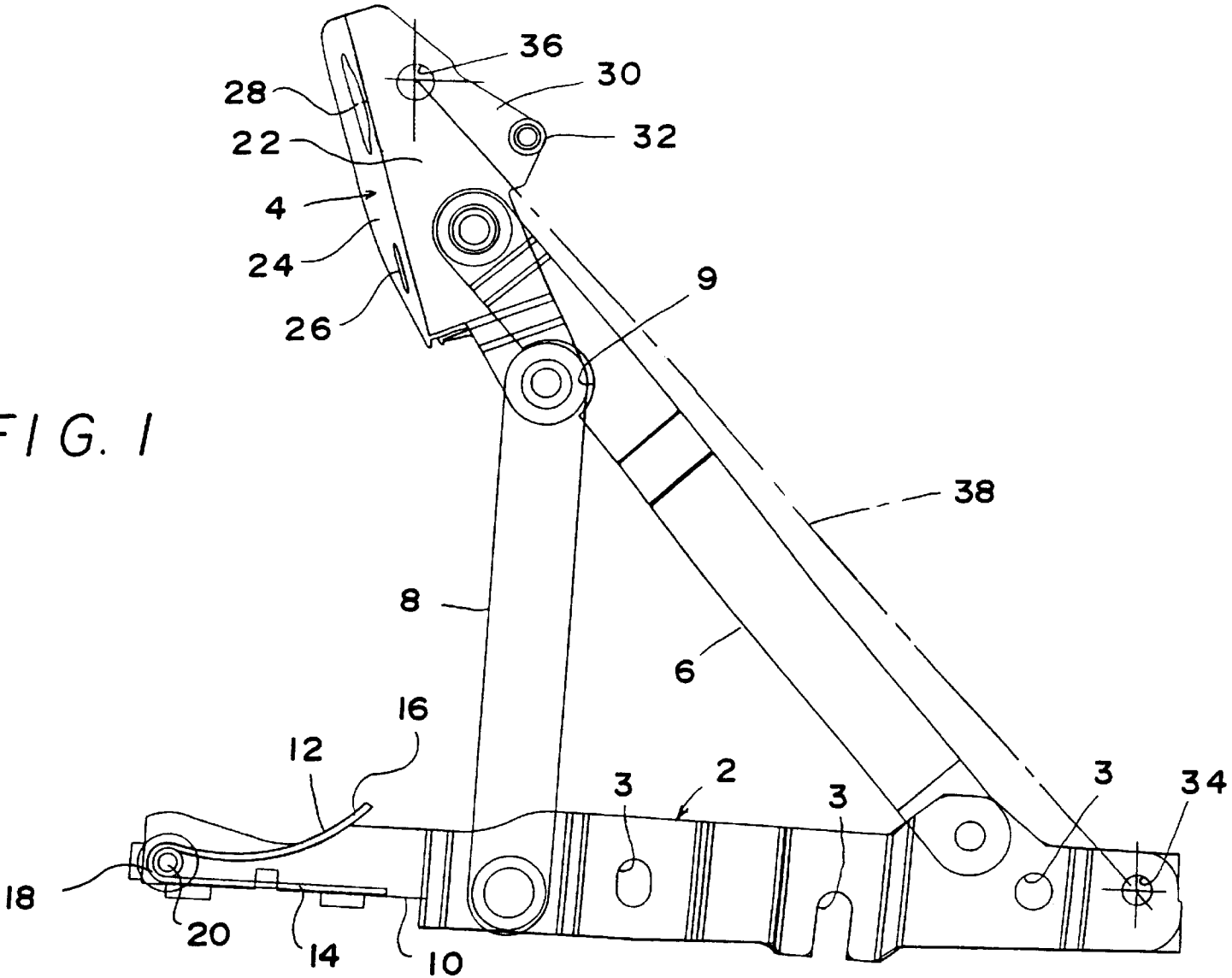
FIG. 1 is a side view of a hinge mechanism in the fully opened condition.

The four-link hinge mechanism shown in the drawings comprises a fixed first hinge part 2, which in use is to be secured by means of apertures 3 to a side gutter (not shown) of a car trunk, and a moveable second hinge part 4 for securing to the lid (not shown) of the trunk. A long link 6 pivotally connects the moveable part 4 to an end of the fixed part 2 which is nearer to opening edge of the lid, while a shorter link 8 pivotally connects the moveable part 4 to the fixed part 2 at a position more remote from the lid edge.

The long link 6 is formed with a cutout 9 near the end which is pivoted to the moveable part 4, enabling the upper end of the short link 8 to enter the cutout 9 and so allow a greater opening of the lid.

The end of the fixed hinge part 2 remote from the lid edge that is, to the left, as viewed in the drawings, is formed into an L-section extension having a horizontal lower portion 10 on which is mounted a generally V-shaped leaf spring 12. The spring 12 has a flat limb 14 held against the upper surface of the horizontal portion 10, and a curved limb 16 whose free end curves upwardly away from the flat limb 14. The limbs 14 and 16 are connected by a bight section 18 which extends around and is held in contact with a horizontal pin 20 secured to the upright portion of the extension.

The moveable hinge part 4 comprises a main upright section 22 and a flange section 24, which is bent at an angle of about 95° to the upright section 22 and has apertures 26, 28 through which it is attached to the lid of the trunk. The upright section 22 incorporates a triangular portion 30 on which is rotatably mounted a roller 32 engagable with the upper surface of the curved limb 16 of the spring 12.

Figure 2:
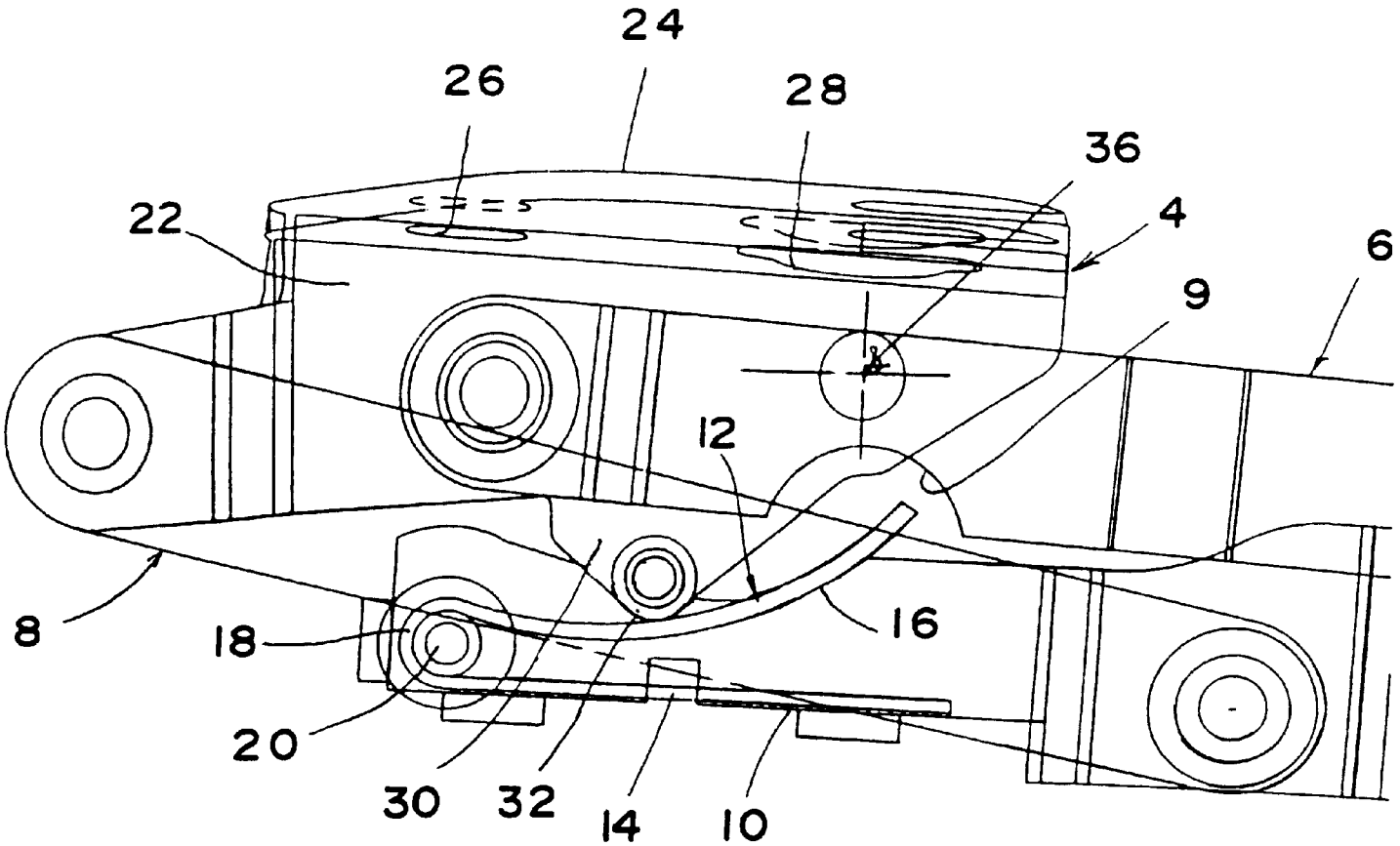
FIG. 2 is an enlarged side view of part of the hinge mechanism of FIG. 1, but in the closed position.

In use, starting from the closed position of the trunk lid shown in FIG. 2, the spring 12 is fully compressed by the roller 32. As soon as the lid catch is released, the spring 12 applies an upward force on the roller 32 causing the lid to start opening. As the roller 32 rolls towards the free end of the spring 12, the upward force diminishes. At the same time the angle of the previously horizontally disposed gas strut reaches a point at which is takes over and continues the upward movement of the lid.

In general it is found that the spring 12 only requires to open the lid edge by approximately 100 mm, at which point the gas strut can take over. Clearly the required upward spring force can be altered by varying the stiffness of the spring itself and by changing the geometry of the four-link hinge mechanism.

Although, as conventional, the gas strut will normally be attached directly between pivotal points on the body and on the lid, alternative fixing points are provided on the present hinge mechanism. Thus, with reference particularly to FIG. 1, fixing prints are provided at the holes 34, 36 of the fixed and moveable hinge parts 2, 4 respectively, the position of the gas strut being shown chain-dotted at 38.

An advantage of this alternative arrangement is that the gas strut can be attached to the hinge mechanism as a complete sub-assembly, which can then be mounted directly to the lid and body in the vehicle assembly line. Obviously, many modifications and variations of the present invention are possible in light of the above teachings. It is therefore to be understood that within the scope of the appended claims, the present invention may be practiced otherwise than as specifically described herein.

I claim:

1. A hinge and linkage mechanism for permitting pivotal movement of a closure with respect to a body member and for assisting the lifting of the closure with respect to the body member, comprising:

a first hinge part adapted to be attached to the body member;

a second hinge part adapted to be attached to the closure;

linkage means hingedly interconnecting said first hinge part to said second hinge part; and spring means fixedly mounted upon one of said first and second hinge parts and disengageably engageable with a portion of the other one of said first and second hinge parts such that when said first and second hinge parts are disposed in close proximity with respect to each other, said spring means causes said second hinge part, to which the closure member is to be attached, to undergo at least a partial lifting movement of the closure with respect to the body member to an elevated position, whereupon continued elevated movement of the closure with respect to the body member, said spring means will be disengaged from said portion of said other one of said first and second hinge parts.

2. A hinge mechanism according to claim 1 in which the hinge mechanism comprises a four-link hinge mechanism defined by said first and second hinge parts, a short link interconnecting said first and second hinge parts, and a long link interconnecting said first and second hinge parts.

3. A hinge mechanism as set forth in claim 2, wherein:

said long link comprises a recessed portion for accommodating one end of said short link when the closure is moved to its elevated position.

4. A mechanism according to claim 1, wherein:

said spring means is mounted upon said first hinge part and is operatively engaged with a portion of said second hinge part.

5. A mechanism according to claim 1 in which the first hinge part comprises an elongated end which, in use with a closure, is remote from the opening edge of the closure.

6. A mechanism according to claim 5 in which the spring means is a leaf spring.

7. A mechanism according to claim 6 in which the leaf spring is generally of a V-shape, comprising first and second limbs joined by a bight section which passes around a pin at the elongate end of the first hinge part.

8. A mechanism according to claim 7 in which the first limb of the spring is flat for engaging a corresponding portion of the first hinge part.

9. A mechanism according to claim 8 in which the second limb, when in its uncompressed state, is of a curved shape with its free end curving away from the first limb.

10. A mechanism according to claim 6 in which the portion of the second hinge part comprises a roller which is engageable with an outer surface of the leaf spring.

11. A mechanism according to claim 1, in which a compressible strut is pivotally connected between the first and second hinge parts.

12. A mechanism according to claim 10 in which the strut is a gas strut.

13. A mechanism according to claim 1 in which a compressible strut is connected directly between the closure and the body member of a vehicle.

14. A hinge mechanism for permitting pivotal movement of a closure with respect to a body member and for assisting the lifting of the closure with respect to the body member, comprising:

a first hinge part adapted to be attached to the body member;

a second hinge part adapted to be attached to the closure;

a strut adapted to have opposite ends thereof operatively connected to the closure and the body member so as to elevate the closure with respect to the body member; and spring means fixedly mounted upon one of said first and second hinge parts and disengageably engageable with a portion of the other one of said first and second hinge parts such that when said first and second hinge parts are disposed in close proximity with respect to each other and the closure member is to be elevated with respect to the body member, said spring means causes said second hinge part, to which the closure member is attached, to undergo at least a partial lifting movement of the closure with respect to the body member whereupon said strut can continue and complete the elevation of the closure with respect to the body member at which time said spring means is disengaged from said portion of said other one of said first and second hinge parts.

15. The hinge mechanism as set forth in claim 14, wherein:

said hinge mechanism comprises a four-link hinge system comprising said first hinge part, said second hinge part, a short link member interconnecting said first and second hinge parts, and a long link member interconnecting said first and second hinge parts.

16. The hinge mechanism as set forth in claim 14, wherein:

said spring means comprises a substantially U-shaped leaf spring member having one limb thereof substantially fixedly mounted upon said first hinge part, and a second limb thereof operatively engageable with said second hinge part.

17. The hinge mechanism as set forth in claim 14, wherein:

said opposite ends of said strut are operatively connected to said first and second hinge parts.

18. In combination, a hinge mechanism for permitting pivotal movement of a closure member with respect to a body member and for assisting the elevation of said closure with respect to said body member, comprising:

a body member;

a closure member;

a first hinge part attached to said body member;

a second hinge part attached to said closure member;

a strut adapted to have opposite ends thereof operatively connected to said closure member and said body member so as to elevate said closure member with respect to said body member; and spring means mounted upon one of said first and second hinge parts and disengageably engageable with a portion of the other one of said first and second hinge parts such that when said first and second hinge parts are disposed in close proximity with respect to each other and said closure member is to be elevated with respect to said body member, said spring means causes said second hinge part, to which said closure member is attached, to undergo at least a partial elevational movement of said closure member with respect to said body member whereupon said strut can continue and complete said elevation of said closure member with respect to said body member at which time said spring means is disengaged from said portion of said other one of said first and second hinge parts.

19. The combination as set forth in claim 18, wherein:

said body member comprises an automotive vehicle body; and said closure member comprises a vehicle trunk lid.

20. The combination as set forth in claim 18, wherein:

said strut comprises a gas strut having opposite ends thereof operatively connected to said first and second hinge parts.

* * * * *